United States Patent [19]

Bechem et al.

[11] Patent Number: 4,796,713

[45] Date of Patent: Jan. 10, 1989

[54] ACTIVATED EARTH DRILL

[76] Inventors: Ulrich W. Bechem; Klaus Bechem; Philip C. Bechem, all of Tiefendorfer Str. 87, D-5800 Hagen, Fed. Rep. of Germany

[21] Appl. No.: 38,212

[22] Filed: Apr. 14, 1987

[30] Foreign Application Priority Data

Apr. 15, 1986 [CH] Switzerland ..... 1465/86

[51] Int. Cl.[4] ..... E21B 4/04; E21B 4/16

[52] U.S. Cl. ..... 175/96; 175/101; 175/104; 175/106; 175/343; 175/365; 175/376

[58] Field of Search ..... 175/101, 104, 106, 57, 175/55, 343, 365, 331, 344, 350, 351, 353, 354, 356, 376, 95, 96

[56] References Cited

U.S. PATENT DOCUMENTS

| | | | |
|---|---|---|---|
| 1,391,626 | 9/1921 | Gilthorpe | 175/101 |
| 1,904,522 | 4/1933 | Pippin | 175/96 |
| 2,776,113 | 1/1957 | Reh | 175/55 |
| 2,797,065 | 6/1957 | Houston | 175/343 |
| 2,903,242 | 9/1959 | Bodine, Jr. | 175/55 |
| 3,285,351 | 11/1966 | Caro | 175/101 X |
| 3,369,618 | 2/1968 | Moore | 175/104 |
| 3,771,611 | 11/1973 | Omura et al. | 175/101 X |
| 4,185,703 | 1/1980 | Guerber | 175/104 X |
| 4,610,317 | 9/1986 | England et al. | 175/331 |
| 4,682,660 | 7/1987 | Barthelemy et al. | 175/96 |
| 4,694,915 | 9/1987 | Bauer et al. | 175/104 X |
| 4,736,987 | 4/1988 | Lenzen et al. | 175/343 X |

FOREIGN PATENT DOCUMENTS

| | | | |
|---|---|---|---|
| 956734 | 9/1982 | U.S.S.R. | 175/331 |

*Primary Examiner*—Hoang C. Dang

*Attorney, Agent, or Firm*—Barnes & Thornburg

[57] ABSTRACT

The invention relates to a drill bit which includes a drive arrangement having two opposed drive shafts which are transverse to the drill rod axis, mechanism for driving the shafts and a rock comminuting cutter which is eccentrically mounted on each of the shafts.

10 Claims, 2 Drawing Sheets

ACTIVATED EARTH DRILL

FIELD OF THE INVENTION

This invention relates to a method of earth drilling and to an activated earth or borehole drill for carrying out the method.

SUMMARY OF THE INVENTION

An activated earth drill according to the invention includes a drill rod, a drill bit which is attached to the rod with the drill bit including a drive arrangement having two opposed drive shafts which are substantially transverse to the axis of the drill rod, means to drive the shafts and a rock comminuting cutter which is eccentrically mounted on each of the drive shafts. Conveniently the rock cutters are of substantially the same mass and are eccentrically located on the drive shafts 180° out of phase with each other so that the drill bit is balanced in use.

In one form of the invention the drive shafts of the drive arrangement are in axial register with each other and normal to the axis of the drill rod.

In another form of the invention the axis of the drive shafts are each downwardly inclined relatively to the drill rod axis so that the rock cutters which are mounted on them converge towards each other and the forward end of the bit.

Further according to the invention the drive shaft means is a gearbox which is driven from surface through the drill rod.

Still further according to the invention the drive means is a motor which is located in the bit for driving the drive shafts and includes means which passes through the drill rod for energising the motor.

In a preferred form of the invention the bit is spheroidal in shape with each of the rock cutters being a substantially hemispherical body which carries on its outer surface hard metal inserts, picks, blades or like rock cutting or comminuting formations.

For flushing rock cuttings and earth from the hole being drilled by the bit, the drill rod carries a conduit through which flushing liquid may be fed to and from the drill bit in use.

A method of earth drilling according to the invention includes the steps of causing a drill bit on the end of a drill rod to be rotated about the axis of the drill rod and rotating an eccentric weight by means in the bit to impart a hammer action to the bit in its drilling direction.

BRIEF DESCRIPTION OF THE DRAWINGS

The invention is now described by way of example only with reference to the drawings in which.

DETAILED DESCRIPTION OF THE PREFERRED EMBODIMENTS

Figure 1:
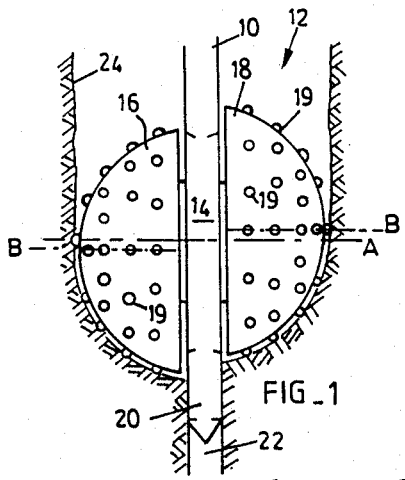
FIG. 1 is an end elevation of the lower end of one embodiment of the drill of the invention in a hole.

The drill of FIG. 1 is shown to include a drill rod 10 and an activated drill bit 12.

The drill bit 12 is spheroidal in shape and includes a disc 14 which is fixed at its upper end to the drill rod 10 and two substantially hemispherical rock comminuting cutters 16 and 18 which carry hard metal rock cutting inserts 19 on their domed outer surfaces. The underside of the disc 14 carries a guide rod 20 which extends forwardly from the bit 12 to be located, in use, in a predrilled pilot hole 22 for guiding the drilling direction of the bit 12.

The rock cutters 16 and 18 are rotated by a drive arrangement which is located in the bit. The drive arrangement includes a drive shaft 26 for each of the cutters. The drive shafts, in this embodiment of the invention, are in axial register on an axis A which is normal to the axis of the drill rod 10. The rock cutters are, however, eccentrically mounted on the drive shafts for rotation about the shafts. The eccentric axes B of the cutters are displaced by equal distances from and on opposite sides of the drive shaft axis A so that the bit is balanced as the cutters 16 and 18 are rotated.

Figure 3:
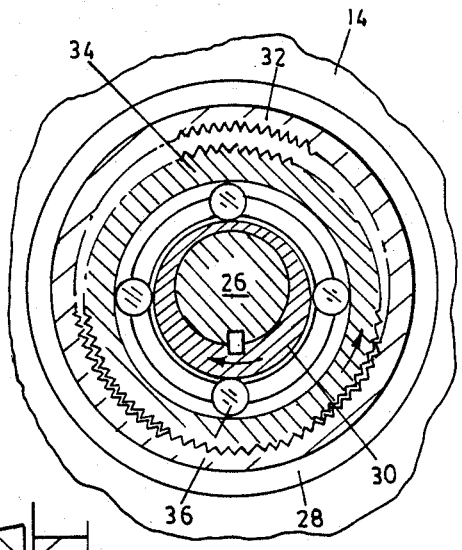
FIG. 3 is a side elevation of the bit drive arrangement shown sectioned on the line 3—3 in FIG. 2.
Figure 2:
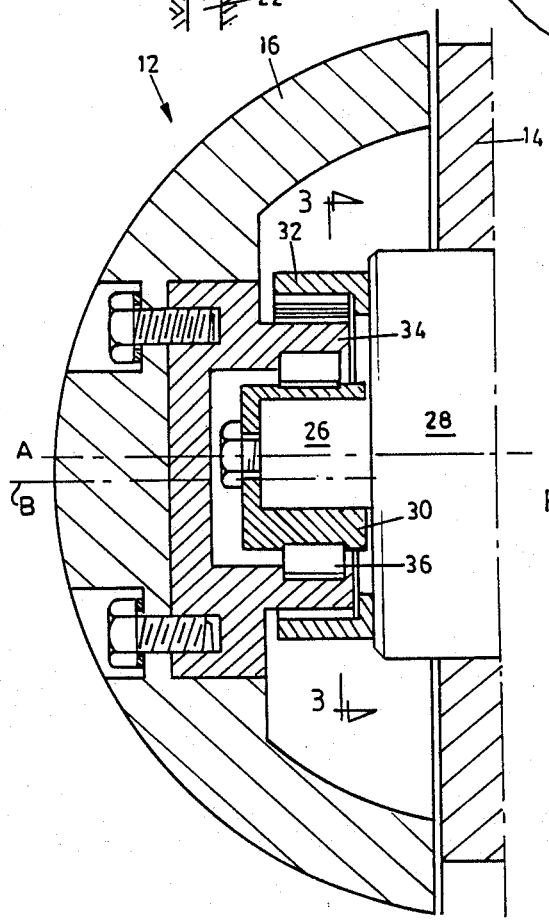
FIG. 2 is a sectioned end elevation of one half of the drill bit of FIG. 1.

FIGS. 2 and 3 illustrate a cutter drive arrangement in which the drive shafts 26 are driven by an electric motor 28 which is located in the bit by being secured to the bit disc 14. The motor is activated by an electric cable which passes from surface to the bit in the drill rod 10.

The drive arrangement includes an eccentric sleeve 30 which is fixed and keyed to the motor drive shaft 26. The key is shown only in FIG. 3. The drive arrangement for the cutter 18 is the same as that for the cutter 16 save that the sleeve 30 of the cutter 18 is fixed to its shaft 26 180° out of phase with that of the illustrated cutter 16. The drive arrangement further includes a ring gear 32 which is fixed to the casing of the motor 28 concentric with the axis of the drive shaft 26, a smaller diameter pinion gear 34 which is fixed on the rock cutter 16 and rotatable concentrically about the eccentric sleeve 30 and its eccentric axis B on roller bearings 36, only four of which are shown in the drawing. Because of the eccentricity of the sleeve 30 and the pinion gear 34 relatively to the axis of the shaft 26 and the ring gear 32 the pinion, by design, is only partially in mesh with the ring gear 32 as is more clearly seen in FIG. 3. It is self evident that the stroke or throw of the eccentric sleeve 30 must be co-ordinated with the difference in diameter of the ring and pinion gears to hold the gears, in their mesh zone, in positive contact as the shaft 26 is rotated.

As the shaft 26 is rotated in a clockwise direction by the motor 28 the mesh zone of the two gears is caused, by the radial pressure of the eccentric sleeve, to rotate with the shaft in a clockwise direction and the cutter 16 will merely wobble eccentrically about the drive axis A until a braking load is imposed on the cutter 16 by engaging the cutter inserts 19 with the ground to be drilled. With the cutters of the drill braked against the material to be drilled the cutters 16 and 18 are caused to rotate, as indicated by the arrows in FIG. 3, in the opposite direction to that of the shafts 26 by the reaction forces acting on the gear teeth in the meshed zone of the gears 32 and 34. Obviously the cutters 16 and 18 which are carried by the pinion gears 34 will rotate at a significantly lower speed than the drive shafts 26. The rotational speed of the cutters may be varied by varying the ratios of the gears 32 and 34.

In use, for example using an eccentric throw of 3 mm, a shaft speed of 4,000 r.p.m. and suitably matched gear ratios the cutters will rotate at a cutting or milling speed of 200 r.p.m. with the two eccentrics providing 8000 hammer stroke per minute. The hammer and cutting action of the drill is further improved by rotating the drill rod 10 and so the bit 12 from the surface.

The hammer blows of the drill bit may be amplified by enlarging the eccentric throw of the drive arrangements or by applying timed hammer blow pulses to the drill rod 20.

Figure 4:
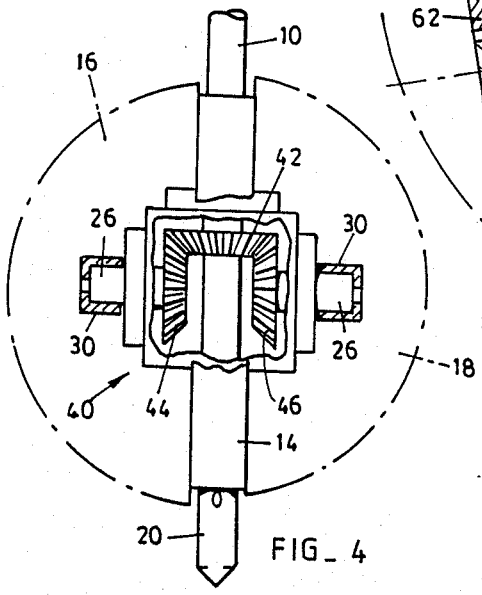
FIG. 4 is a partially schematic view of an alternative drive arrangement for the FIG. 1 drill bit.

The motor drive arrangement of FIGS. 2 and 3 may be replaced by an external drive such as that illustrated in FIG. 4. In the FIG. 4 arrangement the drive shafts 26 are driven through a gearbox 40 which is held in the bit by the disc 14. The gearbox includes three bevel gears 42, 44 and 46 the gear ratios of which are selected to provide the optimum rotational speed of the shafts 26. The gear 42 is connected to a surface driven shaft which is connected to it through the drill rod 10.

As is the case in all of the embodiments of this invention a suitable liquid would need to be pumped in use through the drill rod to the bit to flush earth and rock cuttings from the hole being drilled. In FIG. 1 to 4 embodiments the flushing liquid would pass from the drill rod or a separate liquid conduit in it through suitable bores (not shown) in the disc 14 to exit from ports at or near the base of the disc.

Figure 5:
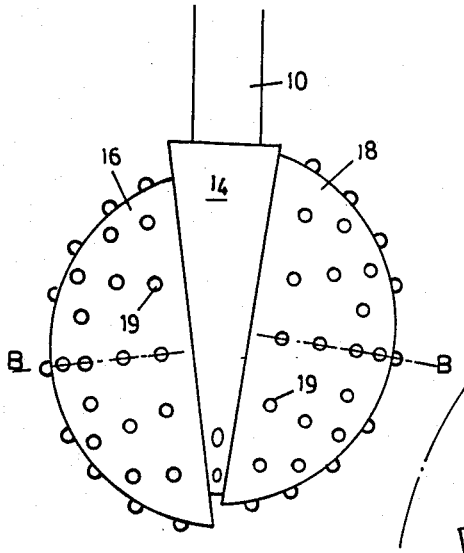
FIG. 5 is an end elevation of a second embodiment of the drill bit of the invention.
Figure 6:
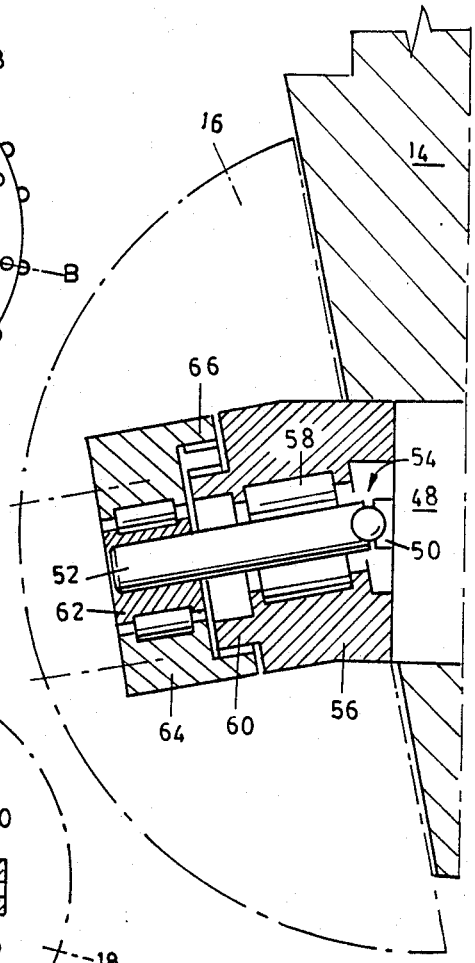
FIG. 6 is a partially schematic sectioned end elevation of one half of the bit of FIG. 5.

The FIG. 5 and 6 embodiment of the drill bit differs from that of FIG. 1 principally in that the axis of the rock cutter drive shafts are downwardly inclined relatively to the axis of the drill rod. The disc 14 is suitably wedged shaped so that the rock cutters 16 and 18 are held in convergence towards each other at the forward end of the bit.

The drive arrangement of the FIG. 5 embodiment of the drill is illustrated in FIG. 6 where it is shown to include an electric motor 48 having a primary drive shaft 50, a secondary drive shaft 52, a universal coupling 54 between the two shafts, a cage 56 which is fixed to the motor for rotatably holding the shaft 52 at its inclined angle on suitable bearings 58, and a pinion gear 60 which is fixed to the cage 56. An eccentric sleeve 62 is keyed to the shaft 52 and carries a housing 64 which is fixed to the rock cutter 16 and is rotatable through bearings on the sleeve 62. The housing 64 carries a ring gear 66 which, as with the previous embodiment, is in partial mesh with the fixed pinion gear 60.

In the FIG. 6 system, however, the eccentric gear is the ring gear 66 and the fixed gear is the pinion 60 which is concentric with the drive shaft 52 which means that the rock cutter will rotate in the same direction as the drive shaft 52. The drive arrangement of the cutter 18 of this embodiment has, unlike that of the FIG. 1 and 2 embodiment where both rock cutter drive arrangements cause the cutters to rotate in the same direction against the drive shaft direction, a drive arrangement which causes the rock cutter 18 to rotate in a direction opposite to that of the cutter 16. To achieve this counter rotation, the drive arrangement of the cutter 18 is the same, with the exception of the primary and secondary drive shafts and the cage 56, as that of FIGS. 2 and 3 where the ring gear is fixed to the cage 56 and the pinion is rotatable with the rock cutter 18 so that the cutter 18 will rotate in the opposite direction to its drive shaft 52 as opposed to the same direction of rotation of the cutter 16 on its shaft.

The opposite direction of rotation of the rock cutters 16 and 18 will cause the drill bit to rotate about the axis of the drill rod without any external force being applied to the drill rod 20 and cause, together with the fact that no gap exists between the convergent cutters on the drill cut line the bit to be self boring without the necessity of a pilot hole. In this embodiment optimum drilling action is obtained by braking the drill rod 10 against rotation while drilling progresses.

With both of the described embodiments of the drill of the invention suitable seals, not shown, would be located between the discs 14 and the cutters of the bits to prevent the ingress of the earth and stone cuttings into the cutters to damage the drive arrangements of the bits.

The invention is not limited to the precise details as herein described. For example to optimise the drill hammer and cutting speeds to suit materials of differing hardness the throw of the eccentrics and the ratios of the drive gears may be varied to obtain the required hammer impact force and cutting speed. In addition the rapidly rotating eccentrics and/or the relatively slowly rotating rock cutters may be provided with additional centrifugal or balance weights in order to increase the counter movement or hammer impact force of the bit.

We claim:

1. An activated earth drill assembly comprising, an elongated drill rod having an upper portion and a lower portion and defining a longitudinal axis, a drill bit attached to the lower portion of the drill rod, the drill bit including a drive arrangement having two opposed drive shafts which extend outwardly away from the drill rod, each shaft defining an axis of rotation, means for rotationally driving the drive shafts, about its axis of rotation and a rock comminuting cutter eccentrically mounted on each drive shaft for rotation therewith, the eccentric mounting providing for both rotational movement of each cutter about the respective axis of rotation and movement of the cutter upwardly and downwardly in a direction generally perpendicular to the axis of rotation as each cutter is rotated by the respective drive shaft.

2. The drill assembly of claim 1, wherein the two rock cutters have masses which are substantially equal and wherein the rock cutters are mounted on the respective drive shafts such that the eccentric upward and downward movement is 180° out of phase.

3. The drill assembly of claim 1, wherein the axis of rotation of the drive shafts are axially aligned and are perpendicular to the longitudinal axis of the drill rod.

4. The drill assembly of claim 1, wherein the rotation axis of each drive shaft is angled downwardly somewhat away from the upper portion of the drill rod.

5. The drill assembly of claim 1, wherein the means for rotationally driving the drive shafts includes, an elongated shaft which extends between the drive shafts and the upper portion of the drill rod, means for rotating the shaft from a position remote from the drive shafts, and a gear box attached to the drive shafts and to the elongated shaft for transmitting the rotation of the elongated shaft directly to the drive shafts.

6. The drill assembly of claim 1, wherein the means for rotationally driving the drive shafts includes, a drive motor disposed within the drill bit attached to each drive shaft, each drive motor configured to impart rotational movement to each associated drive shaft, and means connecting to the drive motors to supply power to the drive motors.

7. The drill assembly of claim 1, wherein the means for rotationally driving the drive shafts includes means for reducing the rotational speed of each rock cutter relating to the rotational speed of the associated drive shaft.

8. The drill assembly of claim 1, wherein the drill bit is spherical in shape with each of the rock cutters being substantially hemispherical in shape and each having an outer surface which is formed to include outwardly extending protrusions.

9. The drill assembly of claim 6, wherein one drive motor is rotated is a first direction thereby rotating the one associated rock cutter in the first direction and the other drive motor is rotated in a second direction opposite the first direction thereby rotating the other associated rock cutter in the second direction.

10. The drill assembly of claim 1, wherein the drill rod is formed to include an inner conduit through which a drill flushing liquid may be forced.

* * * * *